US007703747B2

(12) United States Patent
Arzouman

(10) Patent No.: US 7,703,747 B2
(45) Date of Patent: Apr. 27, 2010

(54) LIFTING DEVICE WITH SECURELY FASTENED LIFT BRIDGE

(76) Inventor: Harry H. Arzouman, 26 Mainsail Dr., Corona Del Mar, CA (US) 92625

( * ) Notice: Subject to any disclaimer, the term of this patent is extended or adjusted under 35 U.S.C. 154(b) by 0 days.

(21) Appl. No.: 11/810,612

(22) Filed: Jun. 6, 2007

(65) Prior Publication Data

US 2008/0303008 A1 Dec. 11, 2008

(51) Int. Cl.
*B66F 3/00* (2006.01)

(52) U.S. Cl. ..... 254/8 B; 254/2 B; 254/134; 254/7 B

(58) Field of Classification Search ..... 254/8 B, 254/7 B, 134, 133 R, 112, 10 B, DIG. 1, 254/DIG. 12, 102, 108, 89 R
See application file for complete search history.

(56) References Cited

U.S. PATENT DOCUMENTS 4,960,264 A * 10/1990 Arzouman et al. ..... 254/8 B
5,110,089 A * 5/1992 Slay ..... 254/8 B
5,183,235 A * 2/1993 Arzouman et al. ..... 254/8 B
6,565,068 B1 * 5/2003 Arzouman ..... 254/126
6,601,827 B1 * 8/2003 Arzouman ..... 254/126
7,100,794 B2 * 9/2006 Sakamoto ..... 221/63
7,410,148 B2 * 8/2008 Arzouman ..... 254/8 B
7,410,149 B2 * 8/2008 Arzouman ..... 254/8 B
7,413,165 B2 * 8/2008 Arzouman ..... 254/8 B
7,413,166 B2 * 8/2008 Arzouman ..... 254/8 B
7,413,167 B2 * 8/2008 Arzouman ..... 254/8 B
7,413,168 B2 * 8/2008 Arzouman ..... 254/8 B
7,413,169 B2 * 8/2008 Arzouman ..... 254/8 B
2003/0218159 A1 * 11/2003 Arzouman ..... 254/8 B

* cited by examiner

*Primary Examiner*—Lee D Wilson
(74) *Attorney, Agent, or Firm*—Roger C. Turner

(57) ABSTRACT

A two-position lift bridge is used with a jack-stand power unit including a forward end, a rearward end, a pair of upward side flanges, with the rearward end having a hydraulic cylinder. A rear cover plate extends horizontally from the side flanges and over the cylinder, and has vertical apertures for positioning the lift bridge, and has a threaded vertical aperture for securing the lift bridge. The frame has a pair of parallel lift arms having forward end that are extendable by the cylinder. Each forward end has a leveling pad pivotally attached having an outwardly extended flange, and one having a vertical aperture and a threaded aperture. The lift bridge includes a rectangular plate one side having downward extending corner flanges with horizontal openings for engaging one of the outwardly extended flanges of the leveling pad. The other side of the plate has a pin extending downward for engaging the aperture in the other leveling pad, and includes a vertical aperture that is aligned with the threaded aperture of the leveling pad for receiving a fastener. The lift bridge can be stored on the cover plate and secured with the fastener. The lift bridge can be positioned on the forward ends of the lift arm by placing the corner flanges on the outward flange of one leveling pad, then positioning the downward pin into the aperture in the other leveling pad, and secured with the fastener.

8 Claims, 5 Drawing Sheets

LIFTING DEVICE WITH SECURELY FASTENED LIFT BRIDGE

BACKGROUND OF THE INVENTION

The invention relates to a commercial two part jacking system for lifting and supporting a corner of an automobile; particularly to an improved lift bridge that is securely fastened to the rear cover plate of a power unit or alternatively securely fastened to the forward ends of lift arms of the power unit. The inventor of the present invention is a pioneer of the two part jacking system and holds numerous patents for two part jacking systems, some of which are described below.

Briefly, the commercial two part jacking system consists of a mobile power unit and a set of separate mechanical jack stands. Examples of the two part jacking system and mobile power unit are described in detail in U.S. Pat. Nos. Re. 32,715; 4,589,630 and 6,986,503. Some examples of the jack stands are described in detail in U.S. Pat. Nos. 4,553,727; 5,110,089; 5,183,235 and 5,379,974. The stands are capable of being vertically extended and retracted from the garage floor or road surface and, when extended, can be locked in place at a desired position by a ratchet and pawl assembly. The power unit has a wheeled mobile chassis adapted to carry a plurality of the jack stands, and has a pair of lift arms adapted to mate with the outermost jack stand for placement and removal.

In use, the commercial mobile power unit is operated from its handle. It is maneuvered under a vehicle to place a jack stand in a desired location for lifting and supporting the vehicle. The power unit is activated from the handle, and the jack stand is then extended vertically to the desired height, thus lifting the vehicle on the stand. By operating the controls at the end of the handle, the operator can cause the power unit to disengage from the stand, and the stand will remain locked in its extended supporting position under the vehicle.

After the stand is raised and locked in place supporting the vehicle, or other load, in an elevated position, the power unit lift arms are lowered and the power unit is disengaged from the stand and pulled away, leaving the stand in position supporting the load. Another jack stand, carried within the chassis, is automatically transferred to the forward end the chassis for placement at another desired location of the vehicle or for use in lifting and supporting another vehicle.

To lower the vehicle and remove the stand, the power unit is maneuvered to re-engage with the stand. The engagement causes any existing jack stands carried within the chassis to be automatically transferred rearward within the chassis. By manually operating a control at the end of the handle, the operator can cause the power unit to re-engage with the stand, and to disengage the ratchet locking mechanism of the stand, and to lower the stand to its original position. The power unit remains engaged with the stand and can be pulled away from the vehicle with the stand carried within the chassis.

The original commercial power units were adapted to carry up to four jack stands within the chassis. Additional jack stands could be acquired to reload the power unit, so that a single power unit could be utilized to efficiently place and actuate numerous jack stands. It was found that many commercial users would utilize all of their available jack stands, and the power unit was thereafter useless until another jack stand was available to be extracted and reused. The present inventor developed a two position lift bridge (and also an automatic-slide-forward bridge) that adapted the power unit to function as a load-lifting jack to more fully utilize the power unit. This invention is illustrated in U.S. Pat. No. 6,779,780 entitled Lift Bridge For Use With a Power Unit and a Load Lifting Jack, along with several other patents related to additional features of the lifting system.

In the continuous development and manufacture of these lifting devices, unique improvements often result in additional inventions. As in the present invention, it was discovered during ship testing that in certain situations, the two-position lift bridge that was nested in the rear cover plate could become dislodged during shipping.

In view of the foregoing situation, it is an object of the present invention to provide an improved two-position lift bridge that can be securely fastened to the rear cover plate.

It is another object to provide an improved two-position lift bridge that can be securely fastened to the leveling pads on the forward ends of the lift arms of the power unit.

SUMMARY OF THE INVENTION

The foregoing objects of a securely fastened two-position lift bridge are accomplished by the present invention. The two-position lift bridge is used with a mobile jack stand power unit, with the power unit including a frame having a forward end and a rearward end, a pair of longitudinal side flanges extending upwardly, with the rearward end having a hydraulic cylinder attached along the longitudinal center. A rear cover plate extends generally horizontally from the side flanges at the rearward end of the frame and over the cylinder. The rear cover plate includes vertical apertures for positioning the lift bridge, and has a threaded vertical aperture for securing the lift bridge to the cover plate.

A lifting means is mounted on the frame and includes a pair of parallel lift arms having forward end that are extendable by the hydraulic cylinder. Each forward end has a leveling pad pivotally attached to the outer sides and the pad has an outwardly extended flange with a rectangular upper surface. At least one of the leveling pads has an aperture in the upper surface for positioning the lift bridge, and has a threaded aperture in the upper surface for securing the lift bridge to the leveling pad.

The lift bridge includes a rectangular plate having a forward end, a rearward end, an upper surface, a bottom surface, a left side and a right side. One side of the plate has a pin extending downward for engaging the aperture in one of the leveling pad; and further includes a vertical aperture that is aligned with the threaded aperture of the leveling pad for receiving a threaded fastener. The other side of the plate has downward extending corner flanges having horizontal openings therein for engaging the outwardly extended flange of the leveling pad.

The lift bridge can be stored on the cover plate with the downward pin inserted into the respective aperture for positioning the bridge, then secured with a suitable fastener into the threaded aperture in the cover plate. The lift bridge can not be dislodged during shipping or movement of the power unit.

The lift bridge can be positioned on the forward ends of the lift arm by placing the corner flanges on the outward flange of the respective leveling pad, then positioning the downward pin into the aperture in the other leveling pad, then secured with a suitable fastener. The lift bridge can be safely used and can not be dislodged during operations of the power unit.

BRIEF DESCRIPTION OF THE DRAWINGS

While the novel features of the invention are set forth in the appended claims, the invention will be better understood along with other features thereof from the following detailed description taken in conjunction with the drawings, in which:

DETAILED DESCRIPTION OF THE INVENTION

The figures and the following specification may describe and define several distinctive inventions that are interrelated within a lifting and supporting system, and may be included in patents (or pending applications) having distinctive sets of claims directed to the respective invention. Also, the improved power unit and jack stands are discussed and described in terms of an automotive jack system, but it should be understood that the system is not limited to automotive uses and can be utilized for lifting and supporting any type of load.

Figure 1:
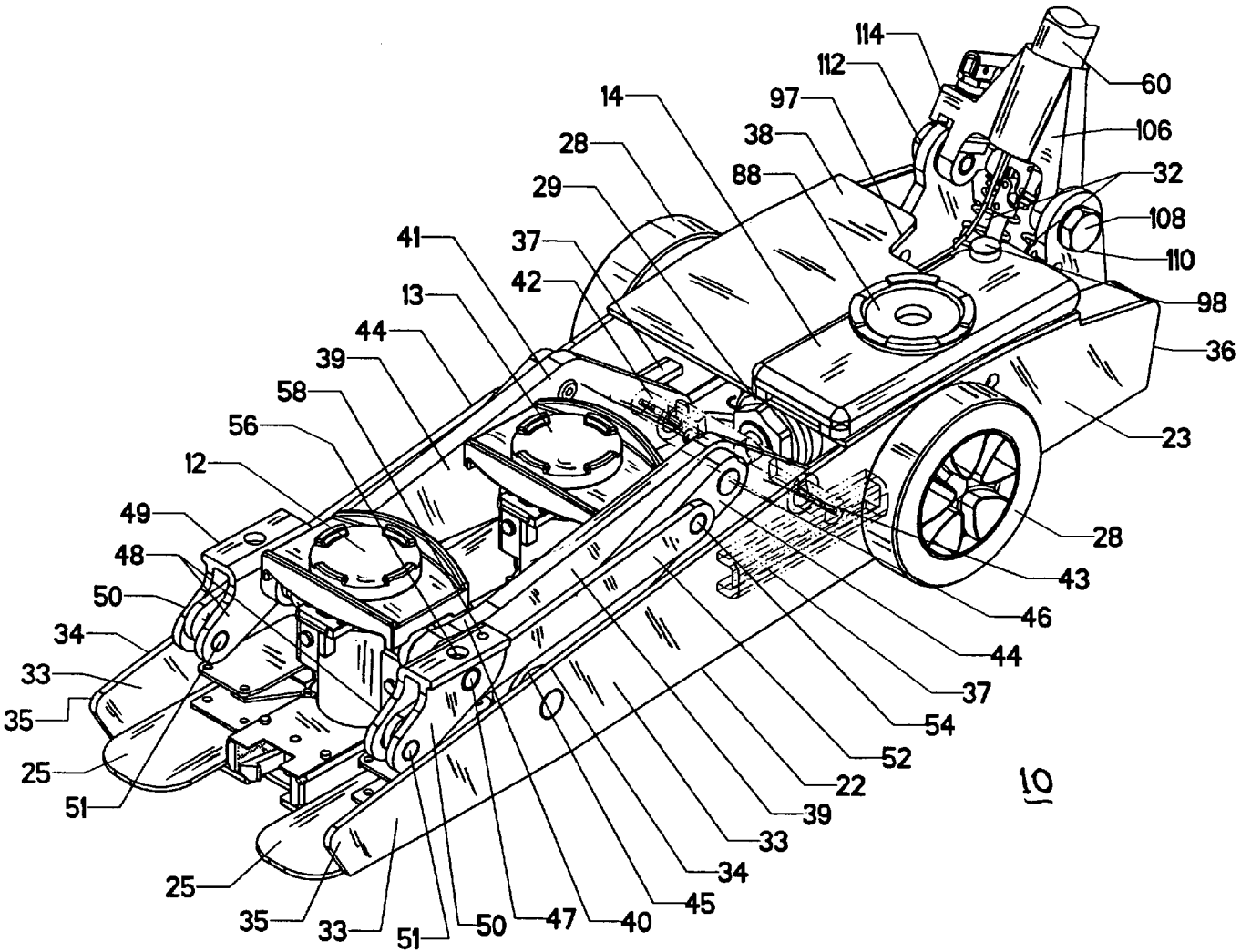
FIG. 1 is top front perspective view of a power unit carrying two jack stands, with the lift bridge positioned on the rear cover plate.
Figure 2:
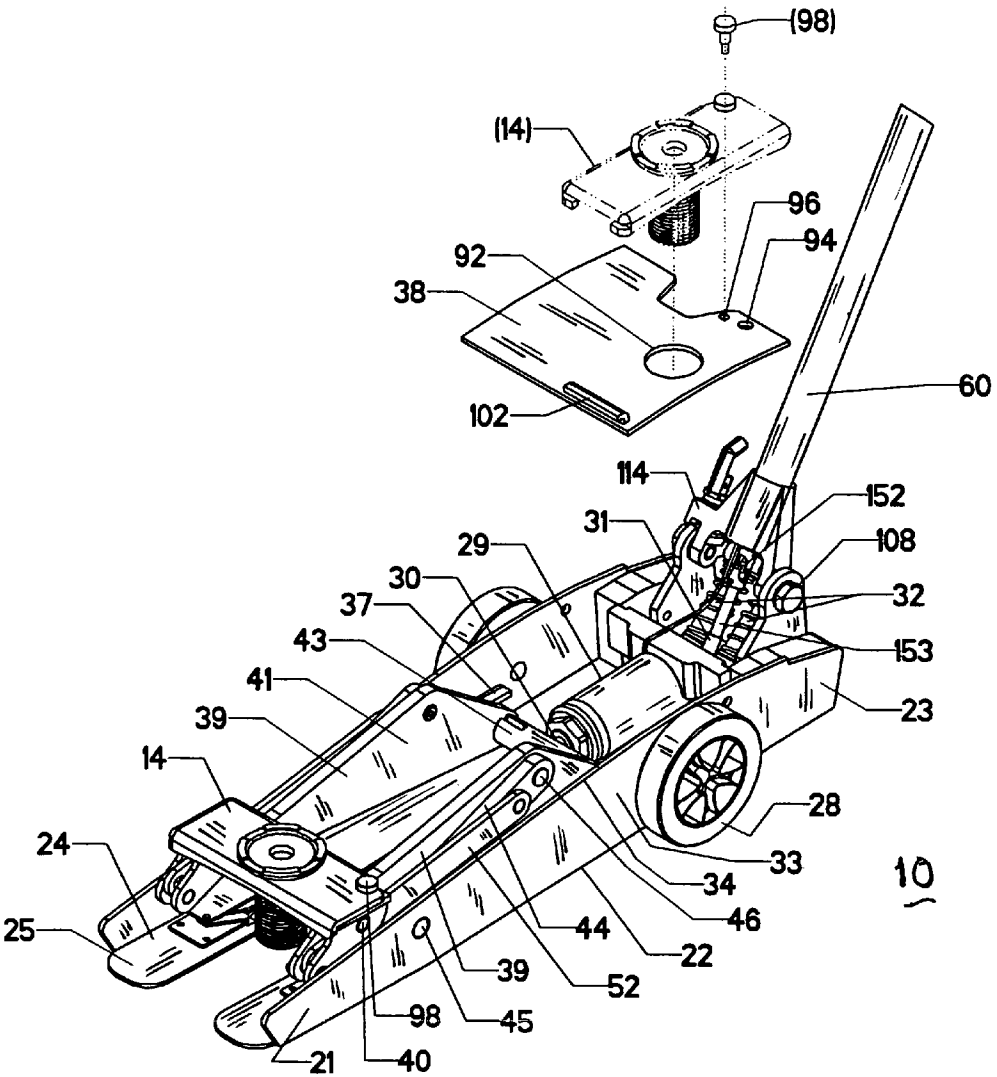
FIG. 2 is a view similar to FIG. 1, with the lift bridge positioned on the lift arms.

Referring first to FIGS. 1 and 2, there is illustrated a mobile power unit 10 for conventional use with one or more jack stands 12 and 13 for lifting and supporting a load. The power unit is also readily convertible for use directly as a load lifting jack by a manual two-position lift bridge 14 of the present invention. The lift bridge as shown in FIG. 1 is placed on the power unit in its first (stored) position, and can be manually placed into its second (operative) position, as shown in FIG. 2, on the forward end of the power unit to convert the power unit for use directly as a load-lifting jack.

The power unit 10 has a generally rectangular frame 20 having a central longitudinal axis, a forward end 21 for loading and unloading the jack stands, a middle portion 22 for securing the lifting mechanism, a rearward end 23 for controlling the power unit, and a bottom 24 thereof. The bottom 24 has a pair of horizontal rounded-nose extensions 25 (also forming a rectangular slotted opening) for engaging the jack stands.

The bottom 24 of the frame further has the forward end 21 thereof substantially flat for providing a solid lifting platform, and has the middle portion and rearward end thereof angled longitudinally upwardly for facilitating mobility of the power unit by a pair of wheels 28 located near the rearward end 23 of the frame.

A hydraulic cylinder 29 having an extendable ram 30 at the forward end thereof, and having a rotatable control valve 31 at the rearward end thereof, is attached along the longitudinal center near the rearward end 23 of the bottom 24 of the frame. The hydraulic cylinder preferably utilizes dual piston type actuators 32 having a first piston actuator for rapidly extending the ram with only a few strokes, until a load exceeding about 150 pounds is encountered; the second piston actuator then takes over to extend the ram (i.e. to lift the load) in the conventional manner.

The frame has a pair of longitudinal side flanges 33 extending upward from the bottom 24 thereof; and has the pair of wheels 28 attached to the outer sides of the flanges on lateral axels near the rearward end 23 thereof. Each side flange has an upper edge 34 with a rounded vertical nose 35 at the forward end 21 thereof and a smooth blunted vertical tail 36 at the rearward end thereof, and has a smooth arcuate contour extending upwardly from the rounded nose to about the height of the wheels and then downwardly mating with the blunted tail, providing an attractive appearance for the frame of the power unit. Each flange further includes a U-shaped longitudinal retaining channel 37 facing inwardly and attached horizontally along the inner sides of the middle portion thereof.

The rearward end 23 of the frame includes a generally rectangular cover plate 38 that extends over and along the upper edges 34 of the side flanges 33 and covers the hydraulic cylinder 29 and some of the control mechanism. The cover plate is contoured to match the upper edge of the side flanges, and provides some protection for some of the components and a clean appearance for the rear of the power unit 10. As discussed, the cover plate provides a convenient place for storing the lift bridge 14.

The power unit includes the pair of lift arms 39 that act in parallel and have forward ends 40, middle portions 41 and rearward ends 42. The lift arms are interconnected at the rearward ends thereof by a lateral push bar 43, with the respective ends of the push bar slidably retained (in suitable pivotal bushings) within the respective retaining channel 37 of the flanges; and the forward ends of the lift arms extend toward the forward end 21 of the frame.

A pair of connecting arms 44 act in parallel and have forward ends 45 and rearward ends 46, have the respective forward end pivotally connected (at 45) near the forward end of the respective flange of the frame 20. The respective rearward end is pivotally connected (at 46) to the middle portion 41 of the respective lift arm 39.

The hydraulic cylinder 29 has the ram 30 at the forward end thereof attached to the center of the lateral push bar 43. When the ram is extended, the push bar and the rearward ends 42 of the lift arms 39 are translated forward along the retaining channels 37 in the flanges of the frame, and the forward ends 40 of the lift arms are thereby raised (in scissor-like fashion with connecting arms 44).

The forward ends 40 of the lift arm 39 have also a pair of leveling pads 47 acting in parallel and are pivotally attached (at 47) to the outer sides thereof (through suitable bushings and fasteners), for providing a level platform thereon for supporting the lift bridge 14. Each leveling pad includes a vertical rectangular plate having a first lever arm 48 extending downward and forwardly at an angle from the plate, and with the plate having an upper flange 49 extending horizontally therefrom, providing a level platform thereon. The platform has another flange extending vertically downward and forwardly therefrom forming a second parallel lever arm 50 thereon. The first and second lever arms having mating lateral apertures 51 in the forward ends thereof.

The leveling pads 47 utilize a pair of leveling links 52 that have a forward end 53 pivotally connected to the apertures 51 at the forward ends of the lever arms with suitable fasteners, and have a rearward end 54 pivotally connected to a point (at 54) on the connecting arm 44; so that as the forward ends of lift arms 39 are raised and lowered, the platforms formed by the upper flanges 49 of the leveling pads are maintained in a substantially horizontal orientation. The leveling pads and leveling links provide a strong, rugged level platform for use with the lift bridge 14.

One of the horizontal flanges 49 (the left one in the present example) has a vertical aperture 56 therein for retaining one side of the lift bridge. This flange further has a threaded vertical aperture 58 therein for securing one side of the lift bridge. The threaded aperture can be form into the flange with a conventional die, or can be provided by securing a suitable nut on the underside of the flange.

A tubular operating handle 60 typically extends rearward and upwardly from the rearward end 23 of the frame of the power unit 10. The tubular handle has a yoke 106 at the distal end thereof having a pair of lateral axels 108 pivotally attached within a left side bracket 110 and a right side bracket 112 with suitable bushings and fasteners. The position and operating range of the handle is manually controlled by a mechanism 114 located on the right side of the yoke.

The tubular handle 60 has a T-bar hand grip 61 transversely attached to the proximal end thereof; and further has a control knob 150 secured to a control shaft 151. The control knob is fixedly attached to the rotatable control shaft 151 that extends through the tubular handle with the distal end thereof connected to a universal joint 152 so that the center of the u-joint is precisely between the lateral axels 108; and the other end of the u-joint is interconnected through a suitable coupling shaft 153 to the rotatable control valve 31 on the hydraulic cylinder. The handle also includes a control lever 154 for controlling the inter-engagement and the cooperative action of the power unit and the jack stand 12.

The operating handle is used in a conventional manner for maneuvering the power unit about on its wheels, operating the hydraulic control valve, and to be pumped up and down for providing energy to actuate the hydraulic cylinder.

Securely Fastened Two-Position Lift Bridge

Figure 3:
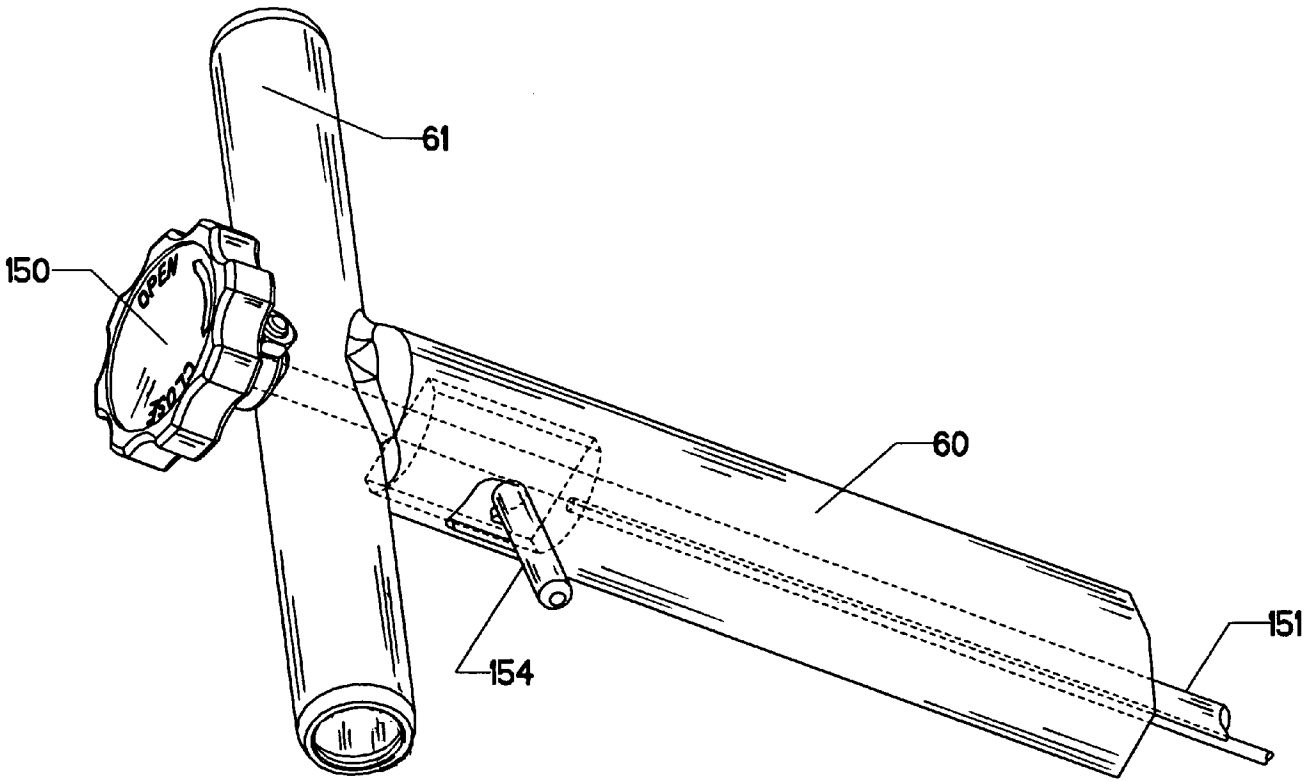
FIG. 3 is a top front perspective view of the upper end of the handle of the power unit.
Figure 4:
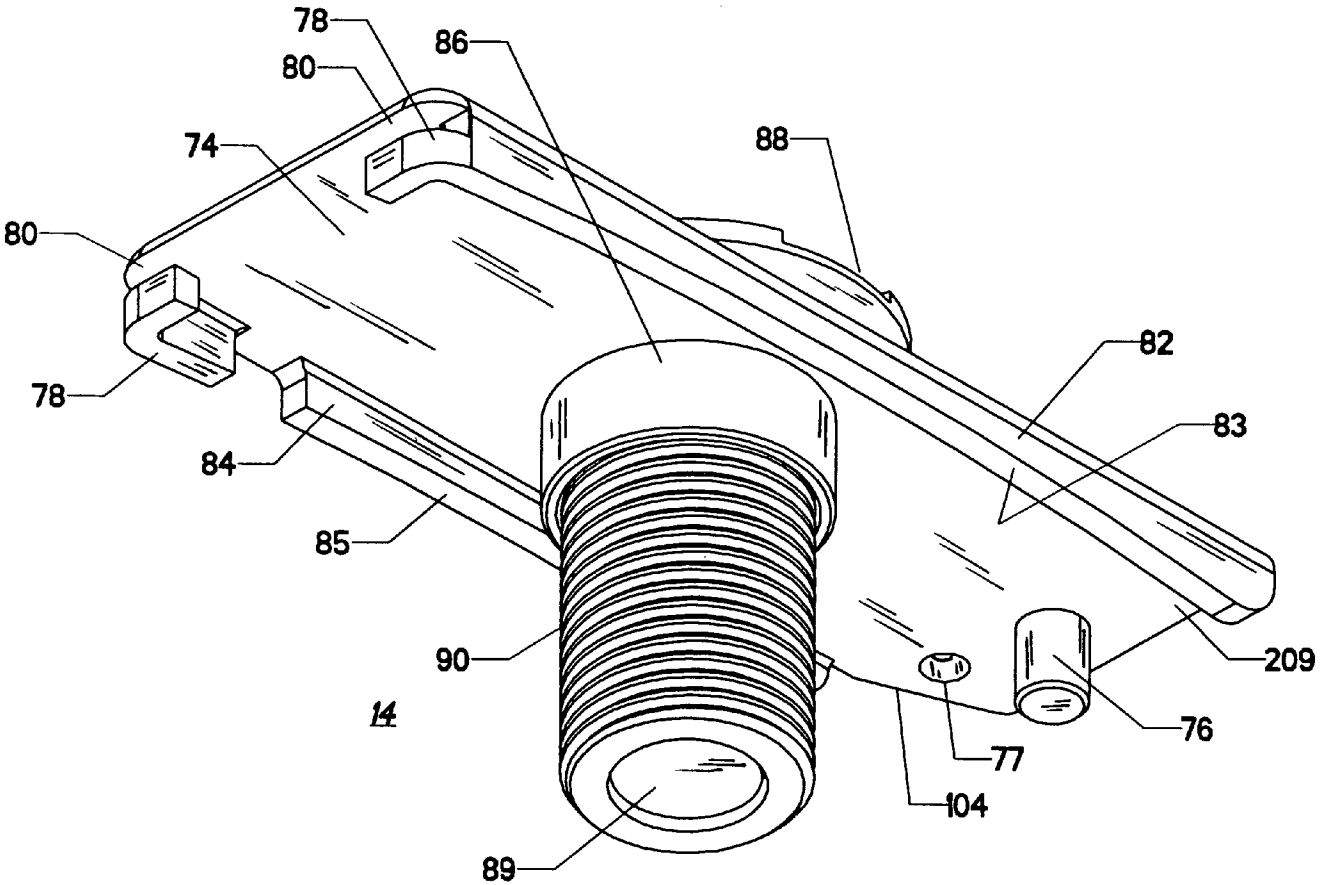
FIG. 4 is a bottom front perspective view of the lift bridge with the compound-screw-out saddle down.
Figure 5:
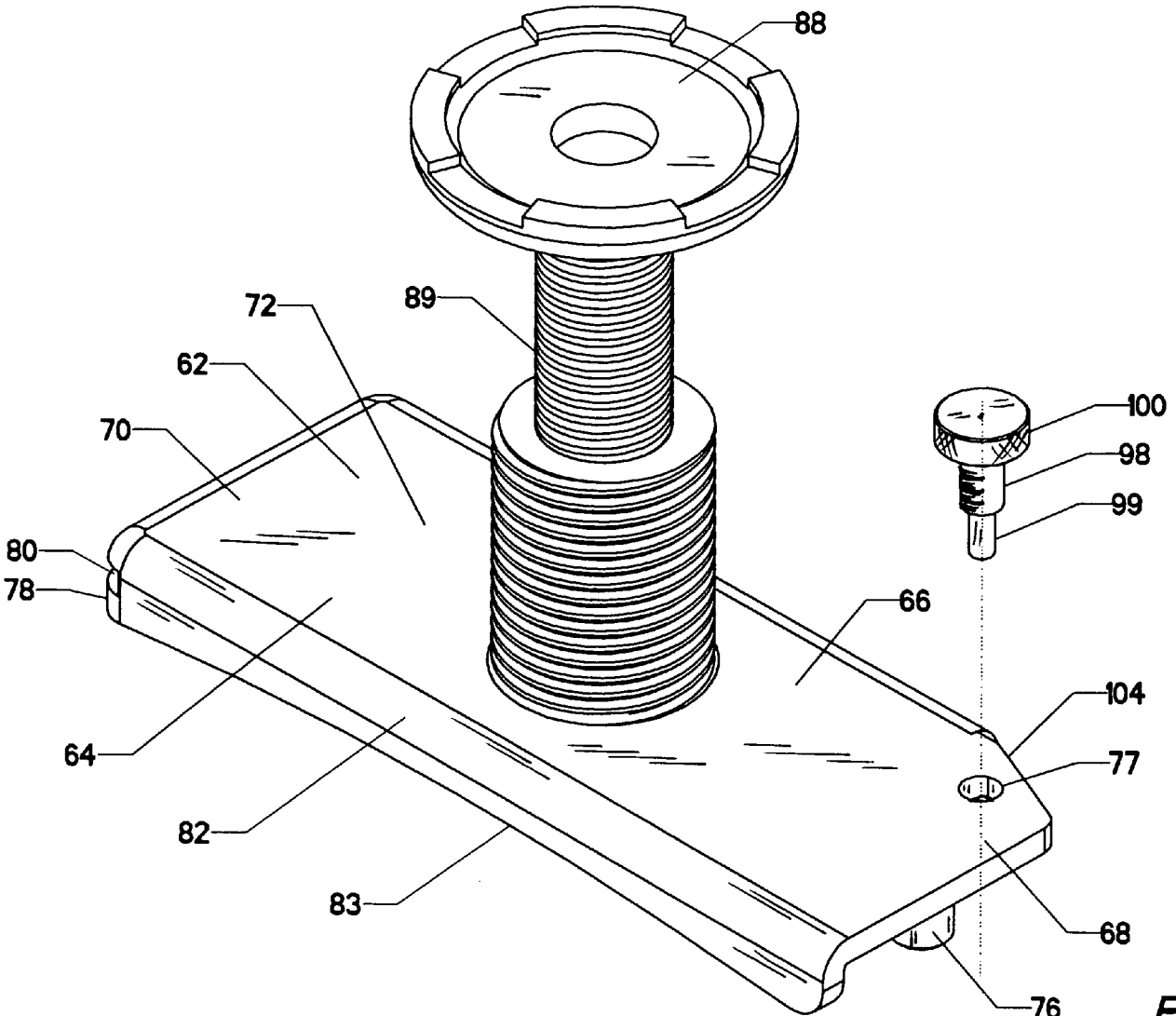
FIG. 5 is a top front perspective view of the lift bridge with the compound-screw-out saddle in the highest configuration, and showing the fastener.

Referring now also to FIGS. 3 and 4, the two-position lift bridge 14 is described in more detail. The lift bridge is utilized to "bridge" the otherwise open span between the forward ends 40 of the lift arms 39 of the power unit, so that the power unit can function as a conventional floor jack for directly lifting a load. The two position bridge refers to the lift bridge being stored in one position on the rear cover plate 38 of the power unit, and being moved to a second position, secured on the pair of leveling pads 47 at the forward ends of the lift arms.

The lift bridge 14 comprises a generally rectangular plate 62 having a forward end 64, a rearward end 66, a left side 68, a right side 70, an upper surface 72, and a bottom surface 74. The bottom surface has at least one large cylindrical pin 76 extending downward from the center of the sides, shown on the left side of the present example. The pin is engageable with the aperture 56 in the left leveling pads for retaining the left side of the lift bridge on the left lift arm. The plate further includes an aperture 77 that is aligned with the aperture 58 in the leveling pad for receiving a suitable fastener.

In its simplest forms, a lift bridge can include the pin 76 on one side of the bridge engaged in a corresponding aperture 56 in one of the leveling pads, and a suitable fastener engaged through the aperture in the other side of the bridge and into the other leveling pad to securely fasten the bridge on the leveling pads. The bridge could similarly utilize pair of pins extending from each side for engaging an aperture in each leveling pad for positioning the bridge, and can be secured thereon with a suitable fastener to one of the leveling pads. The cover plate can similarly include a combination of apertures for positioning the bridge on the cover plate, and utilize a suitable fastener to secure the bridge in position.

In a preferred embodiment, both sides of the bridge can be uniquely secured to the leveling pads. The bottom left side of the bridge includes the pin 76 as described and located slightly inboard of the aperture 56 in the left leveling pad. The bottom right side of the bridge further has a pair of corner flanges 78 extending downwardly from the right side corners and each has a horizontal opening 80 therein for engaging the outer edge of the horizontal flange 49 of the right leveling pad. In this preferred embodiment, the right side of the bridge can be placed over the right leveling pad with the left side elevated so that the left pin clears the left leveling pad; the bridge is then transferred a little to the left so that the right horizontal flange is captured within the openings of the right corner flanges; and the left pin of the bridge is then aligned with the aperture 56 in the left leveling pad, and the bridge is rotated downward to engage the left leveling pad. The lift bridge is then positioned and the right side thereof is locked onto the right leveling pad. A suitable fastener is then inserted through the aperture 77 and engaged into the aperture 58 to secure the bridge onto the leveling pads.

The forward end of the plate has a forward flange 82 extending downward therefrom and the flange has a bottom edge 83 preferably shaped (concaved) to match with the contour of the rear cover plate 38 of the power unit. The rearward end of the plate has a rearward flange 84 extending downward therefrom and the flange has a bottom edge 85 also preferable shaped (concaved) to match with the contour of the rear cover plate of the power unit. The flanges provide substantial strength and rigidity to the plate of the bridge.

The bottom side of the plate further includes a central cylindrical boss 86 having a threaded aperture therein for receiving the threads of a screw-out saddle 88. For extended range, the bridge, preferably utilizes a double-screw-out-saddle having a first threaded shaft 89 extending downward therefrom, and a second tubular shaft 90 having internal threads for receiving the screw threads of the first shaft 89 and having external threads for engaging the threaded aperture 86 in the boss at the center of the bridge. The double-screw-out-saddle in shown in its lowered position in FIG. 3; and is shown in its fully extended position in FIG. 4.

The lift bridge is shown in FIG. 1 in its stored positioned on the rear cover plate 38 of the power unit. The cover plate (see also FIG. 2) includes a large vertical aperture 92 therein for receiving the screw-out saddle, a vertical aperture 94 for receiving the pin 76, and a small (threaded) aperture 96 for receiving a fastener 98. The aperture for receiving the fastener can be formed directly into the cover plate or can be provided with a suitable receiver (threaded nut) secured to the underside of the cover plate. The fastened can be one of a variety of bayonet, push pin or threaded type fasteners, but is preferably a threaded fastener (see FIG. 4) having a reduced diameter distal end 99 for aligning the components, and having a short thumb screw head having a knurled circumference that can be easily rotated by hand for removing the fastener for re-positioning and for securing the bridge in one of the two positions. The screw-out saddle and pins along with the fastener are sufficient to secure the lift bridge on the cover plate for shipping and storage. The cover plate can further include an optional upward flange 102 (somewhat like the horizontal flange of the right leveling pad) for engaging with openings in the corner flanges of the bridge for further securing the bridge on the cover plate.

An incidental, by necessary, feature of the lift bridge of the current example is that the tubular handle 60 is designed to be folded over the power unit for compact shipping and storage. It was necessary to provide a V-notch 97 in the rear of the cover plate 38 to provide clearance for the yoke of the handle. It was also found that the inner rear corner of the left bridge interfered with the folding over of the yoke, when the bridge was stored in position on the cover plate. The inner rear corner of the bridge was therefore beveled or sliced off, as shown at 104, to provide the necessary clearance for the yoke of the handle.

It is concluded that the present invention provides an improved lift bridge that can be securely fastened to the rear cover plate of the power unit; and can alternatively be securely fastened to the leveling pads on the forward ends of the lift arms of the power unit.

While specific embodiments and examples of the present invention have been illustrated and described herein, it is realized that modifications and changes will occur to those skilled in the art. It is therefore to be understood that the appended claims are intended to cover all such modifications and changes as may fall within the spirit and scope of the invention.

The invention claimed is:

1. A two-position lift bridge for use with a mobile commercial jack stand power unit, with the power unit including a generally rectangular frame having a forward end and a rearward end thereof, a pair of longitudinal side flanges extending upwardly therefrom, with the rearward end having a hydraulic cylinder attached along the longitudinal center thereof and having a rear cover plate extending generally horizontally from the side flanges at the rearward end of the frame and over the cylinder, with the rear cover plate including at least one vertical aperture for positioning the lift bridge thereon and having at least one threaded vertical aperture for securing the lift bridge thereon; a lifting means mounted on the frame including a pair of parallel lift arms having forward ends thereon, with the forward ends each having a leveling pad with an outwardly extended flange having a rectangular upper surface and pivotally attached to the outer side thereof; whereas the forward ends of the lift arms are extendable by the hydraulic cylinder; and whereas at least one of the leveling pads has a vertical aperture in the upper surface for positioning the lift bridge thereon and has a threaded vertical aperture in the upper surface for securing the lift bridge thereon, the lift bridge comprising:

a rectangular plate having a forward end, a rearward end, an upper surface, a bottom surface, a left side and a right side, and having at least one pin extending downwardly from the bottom thereof for engaging the aperture in the leveling pad, and having a vertical aperture therein aligned with the threaded aperture of the leveling pad for receiving a threaded fastener there through; and a fastener having a thin flat head and a threaded shaft for engaging the threaded aperture of the leveling pad and the threaded aperture of the cover plate;

said bridge for being positioned laterally and horizontally on the leveling pads and secured thereon by said fastener, whereby the power unit is operable for use as a load lifting jack; and said bridge is alternatively for being positioned on the rear cover plate of the power unit and secured with said fastener, whereby the power unit is operable for use with the jack stand.

2. The lift bridge as in claim 1, wherein one side of the plate further includes downward extending corner flanges having horizontal openings therein for securing one side of the bridge to the outwardly extended flange of the leveling pad for positioning and securing the lift bridge thereon.

3. The lift bridge as in claim 2, wherein at least one of the forward end and the rearward end of the plate further includes a flange extending downwardly therefrom for strengthening said bridge.

4. The lift bridge as in claim 1, wherein one side of the plate has a pin extending downwardly from the bottom thereof for engaging the aperture in one of the leveling pad, and the other side of the plate has downward extending corner flanges having horizontal openings therein for engaging the outwardly extended flange of the leveling pad for positioning and securing the lift bridge thereon.

5. The lift bridge as in claim 1, wherein said fastener is a thumb-screw having a large diameter head with a knurled surface, and the threaded shaft has a reduced diameter distal portion to facilitate aligning the aperture in lift bridge over the desired threaded aperture in the leveling pad and the cover plate.

6. The lift bridge as in claim 1, wherein the plate has an aperture through the center thereof having screw threads formed therein, and further comprising a screw-out saddle having a threaded shaft extending downward therefrom for engaging the threaded aperture in the plate, and wherein the rear cover plate of the power unit further includes a large aperture therein for receiving the shaft extending from the bottom of said bridge, and further includes at least one aperture therein for receiving at least one pin extending from the bottom of the bridge.

7. The lift bridge as in claim 6, wherein the side flanges of the frame of the power unit are arcuate and the rear cover plate is similarly arcuate to conform to the side flanges, and wherein at least one of the forward and rearward flanges has a bottom edge that is generally concave conforming to the arcuate contour of the cover.

8. The lift bridge as in claim 6 wherein the power unit further includes a handle having a pivotal yoke and that can be folded forward over the power unit, and the lift bridge includes a beveled rearward inner corner so that the lift bridge when on the cover plate does not interfere with the pivotal yoke.

* * * * *